US005385197A

United States Patent [19]

Sourlier

[11] Patent Number: 5,385,197

[45] **Date of Patent: * Jan. 31, 1995**

[54] METHOD AND APPARATUS FOR FEEDING A RECESSED SAND MOLD WITH MOLTEN METAL UNDER LOW PRESSURE

[75] Inventor: Pascal Sourlier, Maxeville, France

[73] Assignee: Pont-A-Mousson, Nancy, France

[ * ] Notice: The portion of the term of this patent subsequent to Jun. 8, 2010 has been disclaimed.

[21] Appl. No.: 984,730

[22] Filed: Dec. 4, 1992

Related U.S. Application Data

[63] Continuation of Ser. No. 718,702, Jun. 21, 1991, abandoned.

[30] Foreign Application Priority Data

Jun. 27, 1990 [FR] France ..... 9007862

[51] Int. Cl.[6] ..... B22D 17/06

[52] U.S. Cl. ..... 164/119; 164/306

[58] Field of Search ..... 164/119, 306, 133, 135, 164/362, 255, 63

[56] References Cited

U.S. PATENT DOCUMENTS 2,303,608 12/1942 Campbell ..... 164/133
2,940,142 6/1960 Wells et al. .
3,628,598 12/1971 MacNeil et al. .
3,656,539 4/1972 Zickefoose .
4,008,749 2/1977 Bellocci et al. ..... 164/119
4,112,997 9/1978 Chandley ..... 164/119
4,133,370 1/1979 Bellocci et al. .
4,143,687 3/1979 Bellocci .
4,989,665 2/1991 Yaniagiwa et al. ..... 164/135

FOREIGN PATENT DOCUMENTS 2295808 12/1974 France .
2367566 10/1976 France .
2556996 12/1983 France .

*Primary Examiner*—Kuang Y. Lin
*Attorney, Agent, or Firm*—Sughrue, Mion, Zinn, Macpeak & Seas

[57] ABSTRACT

A multi-stage sand mold 4 defines a plurality of casting impressions or cavities 31 fed with molten metal from a tubular central chamber 28 via a pair of parallel intermediate ducts 30A, 30B extending horizontally outwardly from opposite sides of the chamber, and ingates 32A, 32B extending between the ducts and the impressions. All of the ingates fed by a single intermediate duct open into the same impression, thus implementing a balanced and uniform distribution of molten metal to the impressions.

8 Claims, 2 Drawing Sheets

METHOD AND APPARATUS FOR FEEDING A RECESSED SAND MOLD WITH MOLTEN METAL UNDER LOW PRESSURE

This is a continuation of application Ser. No. 07/718,702 filed Jun. 21, 1991, now abandoned.

BACKGROUND OF THE INVENTION

This invention concerns low-pressure metal casting in a multi-stage recessed sand mold. It further concerns a method and apparatus for feeding several impressions of a single stage of such a mold with low-pressure casting metal, the feed occurring through a casting chamber via at least one intermediate duct and ingates.

A low-pressure casting method (see, for example, commonly assigned French Patent Nos. 2,295,808; 2,367,566; and 2,556,996) is particularly advantageous, when compared with gravitational casting, for the production of thin-walled metal parts and/or parts having complex shapes and/or parts of large size. In fact, the pressure exerted by the metal, which results from the injection of a gas inside a water-tight cavity containing the molten metal, may be closely and accurately controlled to push the metal into all of the innermost recesses of the impressions.

In conventional techniques, at each stage of the mold, a single intermediate duct, or two such ducts positioned diametrically opposite each other, connect the casting chamber to an entire set of ingates belonging to the stage. This method exhibits the following disadvantages linked to the large cross-section of the duct(s):

(1) When the parts to be cast have a complex elongated shape and their impressions are arranged head to tail at each stage of the mold, the ingates are not arranged symmetrically in relation to the casting duct which feeds them, and the number of ingates for a given duct may vary from one impression to another at the same stage. Thus, the filling of two or more impressions in a given stage is not balanced.

(2) The single duct has a large cross-section promoting turbulence in the metal flow and, consequently, the erosion of the sand and occlusion caused by air bubbles, thus compromising the integrity of the parts obtained; furthermore, a duct of this kind consumes a large quantity of metal when filled.

(3) In the case of a multiple-stage mold, because of the large section of the intermediate duct, it is not possible to cause the metal to rise rapidly to the top of the casting chamber, and filling actually occurs stage by stage, a phenomenon which makes it impossible to profit from all of the advantages of low-pressure casting.

(4) When the pressure is lowered and after the solidification of the ingates, which thus form obturators (see the aforementioned French Patent No. 2,295,808), the metal contained in the intermediate duct, which constitutes a relatively large volume that has cooled appreciably, returns to the casting cavity. During the following casting operation, the cooler metal is the first to rise into the casting chamber, thus adversely affecting the quality of some molded parts. For the same reason, an excessive metal flow is required during each casting.

SUMMARY OF THE INVENTION

An object of the invention is to overcome these problems. To this end, the method according to the invention is characterized by the fact that only ingates emptying into a single impression are provided for each duct.

According to other features:

a) a liquid metal flow, sufficient to cause the metal to rise above all of the intermediate ducts, is sent through the feed tube;

b) the feed pressure of the mold is kept constant until the solidification of all of the intermediate ducts, and then the pressure is decreased.

A further object of the invention is to provide a recessed sand mold designed to implement the above method. The mold, which comprises a casting chamber and at least one stage fitted with several impressions fed by ingates connected to the casting chamber by at least one intermediate duct, is characterized by all of the ingates fed by a single intermediate duct emptying into the same impression.

According to other features:

a) each impression is fed by at least two intermediate ducts extending outwardly on opposite sides of the casting chamber;

b) the sum of the areas of the inlet sections of the intermediate ducts belonging to each stage is substantially less than the area of the section of the casting chamber;

c) the mold comprises multiple, vertically stacked stages.

DETAILED DESCRIPTION OF THE PREFERRED EMBODIMENT

Figure 1:
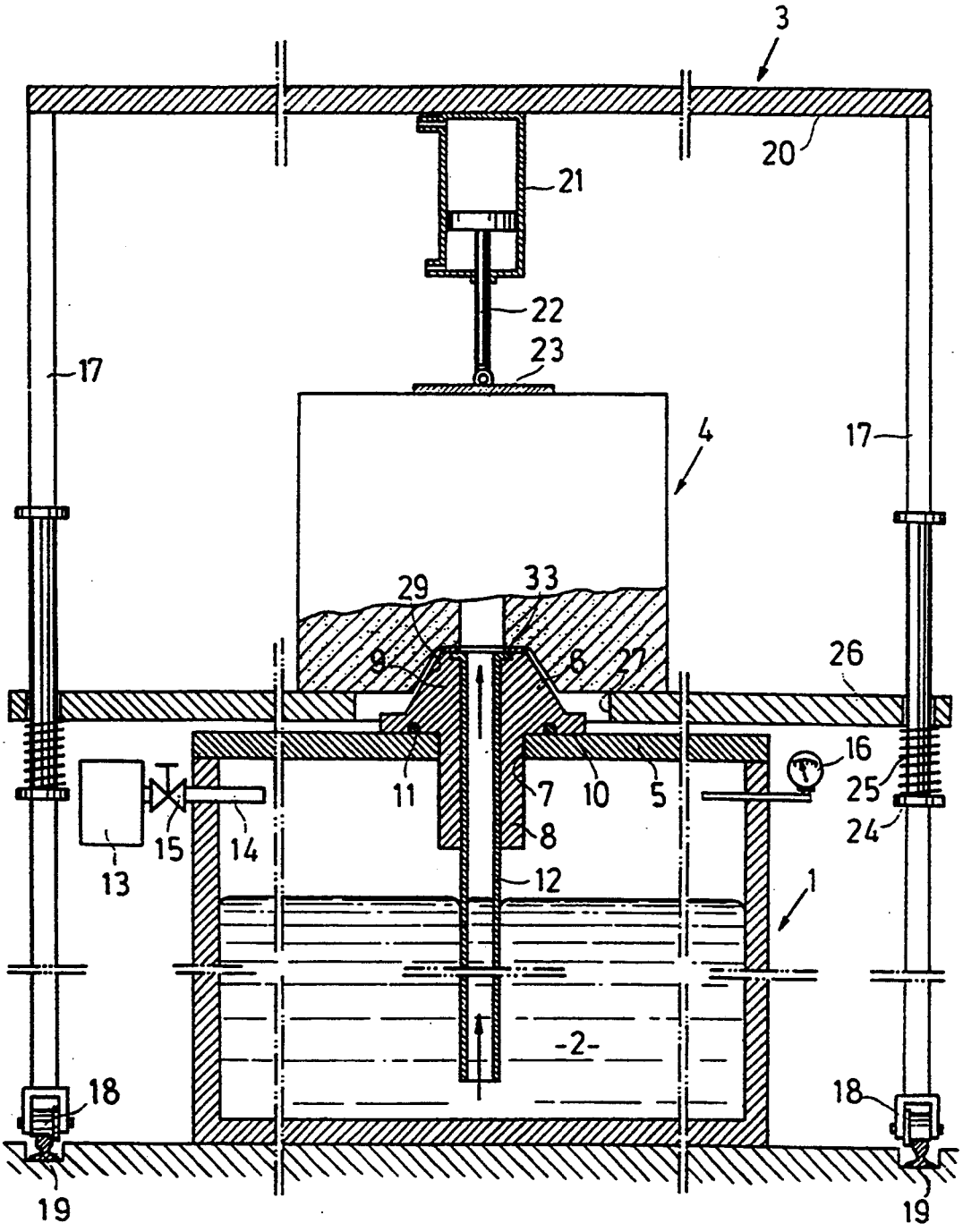
FIG. 1 is a vertical cross-section of a diagrammatic representation of a casting installation according to the invention.

The installation shown in FIG. 1 comprises a chamber 1 forming a cavity or reservoir for liquid metal 2, a mold-support frame 3, and a sand mold 4. This installation is used for the low-pressure casting of cast iron (gray cast iron or spherulitic graphite iron), steel, or a superalloy in the mold 4. Except for the internal configuration of the mold, the installation is identical to the one described in French Patent No. 2,295,808, cited above.

The stationary cavity 1 comprises an upper cover 5 attached in water-tight fashion to its lateral walls and locked in place using suitable means (not illustrated). A casting nozzle 6 passes through an orifice 7 in the cover 5. This nozzle 6 comprises a lower tubular part 8 whose external diameter matches the diameter of the orifice 7, and an upper part 9 having a generally tapered shape, whose large flat base 10 rests impermeably on the periphery of the orifice 7. A gasket 11 formed from an asbestos cord is housed in a recess in the base 10 of the nozzle. A feed tube or pipe 12 made of a heat-resistant material and immersed in the cast iron until it reaches the vicinity of the bottom of the cavity 1 passes through the nozzle; the upper part of the pipe 12 opens into the center of the nozzle 6, at the level of its flat upper surface.

The cavity 1 is connected to a pressurized gas source 13 by a pipe 14; the cavity is selectively connected to the pressure source or to the atmosphere by a suitable valve device 15 external to the cavity. A pressure gauge 16 makes it possible to monitor the pressure inside the cavity during casting.

The frame 3 comprises posts 17 fitted at their base with wheels 18 riding on two rails 19. The posts 17 are connected at their upper ends by a ceiling 20 supporting a jack 21 directed downwardly and whose piston rod 22 supports a support plate 23 joined to its lower end.

Each of the posts 17 is also fitted with a collar 24 on which a helical spring 25 rests. A horizontal base plate 26 may slide vertically along a portion of the posts 17 located above the collars 24. This plate 26 rests constantly for support on the upper ends of the springs 25 and is biased upwardly by them. When there is no downward pressure applied to the plate 26, it is positioned at a level above that of the upper surface of the nozzle 6. A circular opening 27 having a diameter large enough to allow the nozzle 6 to pass through it is cut in the plate 26.

Figure 2:
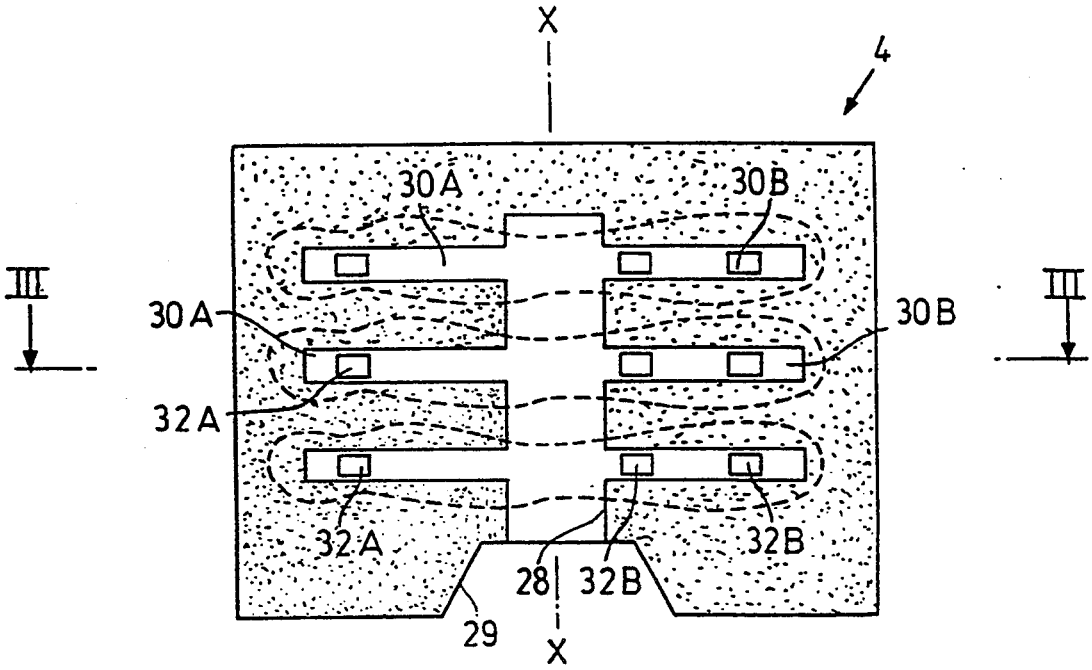
FIG. 2 illustrates a mold used in this installation, shown in cross-section along line II—II in FIG. 3.

The mold 4 is a solid multi-stage recessed mold, for example comprising three stages, as illustrated in FIG. 2. It comprises a vertical casting chamber 28 having a circular section approximately equal to that of the feed tube 12. This chamber is open at the base, which has a flared truncated recess 29 matching the shape of the nozzle 6. It extends up to a certain distance from the upper end surface of the mold.

Figure 3:
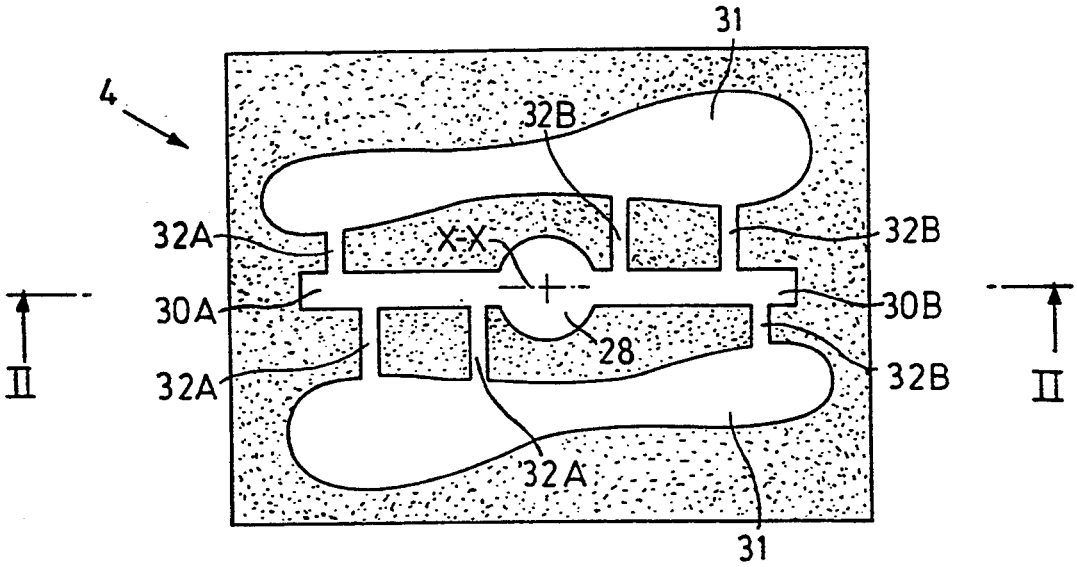
FIG. 3 is a cross-section view along line III—III in FIG. 2.

The three stages are identical, and the structure of each stage is shown in FIG. 3. Four intermediate ducts extend horizontally outwardly from the vertical casting chamber 28, of which two 30A extend in a first direction, parallel to each other, and the two others 30B extend in the opposite direction, also parallel to each other. Each duct 30B forms an extension of duct 30A, and vice versa. Each stage further comprises two identical elongated asymmetrical impressions 31 arranged head-to-tail, i.e., symmetrically in relation to the vertical axis X—X of the casting chamber. Each impression, extending on either side of the chamber 28, is fed by three ingates. In the example shown, for each impression there is one ingate 32A on one side of the chamber and two ingates 32B on the other side. An ingate 32A connects the upper impression in FIG. 3 to a duct 30A, and two ingates 32B connect it to the opposite, extension duct 30B; vice versa for the lower impression. Each duct 30A or 30B connects the casting chamber to only a single impression 31. By studying the entire stage (FIG. 3), it can be seen that, since the ducts are positioned as a function of the metal-feed requirements of the impression, the ingates feeding one of the impressions are positioned at varying distances from the axis X—X, and there is no reason to position them opposite those which feed the other impression.

The ducts 30A and 30B have a relatively small cross-section, since each of them feeds only a small number of ingates. More specifically, the sum of the areas of the sections of the intermediate ducts 30A, 30B belonging to a single stage is substantially less than the area of the section of the casting chamber 28; e.g., it is less than 10% of this area. If the ducts have a variable cross-section along their lengths, then their inlet cross-sections fulfill this condition.

The installation functions in the following way. Since the frame 3 is located at a distance from the cavity 1, a suitable heat-resistant water-tight joint 33 is installed on the bottom of the recess 29 of the mold 4. The mold 4, which contains a core (not shown) in each impression, is positioned on the plate 26 and centered over the opening 27. Next, the frame is moved on the rails 19 to a position above the cavity i containing the liquid cast iron, so that the nozzle 6 is positioned opposite the recess 29 of the mold. The jack 21 is then extended to lower, by means of the plate 23, the mold 4 and its support plate 26 against the force of the springs 25. This operation tightens the joint 33 between the bottom of the recess 29 and the nozzle, and ensures a water-tight connection of the casting chamber to the feed tube.

The cavity 1 is then connected to the pressure source 13 by the valve device 15. The pressure acting on the free surface of the cast iron causes it to rise in the tube 12. The cast iron fills the chamber 28 of the mold, the ducts 30A and 30B, and the impressions 31. The pressure is maintained for a predetermined period of time as a function of the dimensions and shapes of the parts to be produced. During this period, the chamber 28 acts as a reservoir or feeder, by supplying to the impressions the additional liquid cast iron needed to compensate for shrinkage. Next, the ingates and intermediate ducts solidify, the gas pressure is reduced to atmospheric pressure in the cavity 1 by the valve device 15, and the liquid cast iron in the chamber 28 and the tube 12 falls back into the cavity, draining these two passages.

The jack pressure is then released, the mold/support plate 26 assembly is pushed away from the nozzle 6 by the springs 25, and the entire frame 3 is moved horizontally away from the cavity on the rails 19.

Because of the aforementioned sizing of the cuts 30A, 30B and by providing a suitable gas flow through the duct 14, the liquid metal rises rapidly into the chamber 28, the necessary metallostatic pressure is established in the ducts belonging to each stage, and the two impressions in each stage are fed individually by their associated pair of ducts 30A and 30B. This makes it possible to simultaneously fill all of the impressions, no matter what their shape. Moreover, the relative narrowness or limited cross-section of the intermediate ducts limits the delivery rate of the metal flowing through them, this leading, first, to better control, less turbulence, and greater capacity to accurately repeat the filling operation, and second, to minimal movement of the metal during each casting. The ultimate result is the improved integrity of the cast parts.

It should further be noted that the use of intermediate ducts as obturators prevents any flow of appreciably cooled metal back into the cavity, without at the same time reducing the metal yield. This represents a substantial advantage as regards the capacity to reproduce the casting conditions. Furthermore, during the next casting operation, the slightly cooled metal contained in the casting chamber is distributed among all of the impressions of the mold, and the thermal balance is particularly favorable.

I claim:

1. A method for low-pressure metal casting comprising the step of providing molten metal for feeding an apparatus, wherein said apparatus comprises (i) a vertical chamber, (ii) at least two intermediate ducts extending horizontally outwardly therefrom and in communication with said vertical chamber, (iii) a plurality of ingates in communication with each of the at least two intermediate ducts, and (iv) at least two impressions, wherein all the ingates of a single intermediate duct are in communication via the ingates with the same impression;

and wherein each intermediate duct is positioned as a function of the metal-feed requirements of the single impression with which said each intermediate duct is in communication;

passing the molten metal sequentially into the vertical chamber, to the at least two intermediate ducts, to the pluralities of ingates, and to the at least two impressions;

wherein the impressions are asymmetrical with respect to each other and each has a larger end and a smaller end and wherein there is a single ingate in communication with the smaller end of each of said impressions and two ingates in communication with the larger end of each of said impressions.

2. A method according to claim 1, further comprising the step of establishing a sufficient molten metal flow rate in the vertical chamber to cause the molten metal to rise above all of the intermediate ducts.

3. A method according to claim 1, further comprising the steps of maintaining the molten metal pressure in the vertical chamber constant until the molten metal solidifies in the intermediate ducts, and thereafter reducing said pressure.

4. An apparatus for low-pressure metal casting, comprising, a sand mold defining at least two impressions adapted to be fed with molten metal from a vertical chamber, at least two intermediate ducts extending horizontally outwardly from and in communication with the vertical chamber, and ingates extending between and in communication with the intermediate ducts and the impressions, wherein all the ingates of a single intermediate duct are in communication via the ingates with the same impression;

wherein each intermediate duct is positioned as a function of the metal-feed requirements of the impression with which said each intermediate duct is in communication; and wherein the impressions are asymmetrical with respect to each other and each has a larger end and a smaller end and there is a single ingate in communication with the smaller end of each of said impressions and two ingates in communication with the larger end of each of said impressions.

5. An apparatus according to claim 4, wherein each impression is fed by two intermediate ducts extending outwardly from opposite sides of the vertical chamber.

6. An apparatus according to claim 5, wherein the sand mold defines at least two vertically stacked stages traversed by the vertical chamber.

7. An apparatus according to claim 6, wherein the sum of the cross-sectional areas of the intermediate ducts associated with each stage is substantially less than the cross-sectional area of the vertical chamber.

8. An apparatus according to claim 7, wherein the vertical chamber is centrally oriented in the mold, and is straddled by two impressions in each stage, and wherein two parallel intermediate ducts extend outwardly from each side of the vertical chamber, one pair of said parallel ducts being axial extensions of another pair of parallel ducts.

* * * * *